United States Patent [19]

Boone

[11] Patent Number: 4,870,764

[45] Date of Patent: Oct. 3, 1989

[54] GREETING CARD ARRANGEMENT

[75] Inventor: Stephen D. Boone, Louisville, Ky.

[73] Assignee: Instant Product Inc., Louisville, Ky.

[21] Appl. No.: 61,714

[22] Filed: Jun. 15, 1987

[51] Int. Cl.[4] ..... G09F 1/00

[52] U.S. Cl. ..... 40/124.1; 40/427; 40/1; 229/92.8; 272/8 R; 206/530; 206/457

[58] Field of Search ..... 40/124.1, 427, 158 R, 40/584, 158.1, 159, 1; 206/45.31, 216, 472, 457, 527, 530, 232, 205, 524.8, 813; 229/92.8; 272/8 R; 446/385; 273/153 R; 428/13, 12

[56] References Cited

U.S. PATENT DOCUMENTS

| | | | |
|---|---|---|---|
| 2,246,622 | 6/1941 | Dennis | 206/472 |
| 2,498,074 | 2/1950 | Feldman | 272/8 R |
| 2,941,664 | 6/1960 | Palmer | 40/158 R |
| 3,339,480 | 8/1965 | Lightner et al. | 206/45.31 |
| 3,544,007 | 1/1970 | Bordman | 206/457 |
| 3,680,250 | 8/1972 | Hetrick | 206/527 |
| 4,203,516 | 5/1980 | Stonoga et al. | 229/92.8 |
| 4,387,804 | 6/1983 | Austin | 206/530 |

FOREIGN PATENT DOCUMENTS

| | | | |
|---|---|---|---|
| 335463 | 12/1903 | France | 206/232 |
| 366415 | 10/1906 | France | 229/92.8 |
| 1204801 | 1/1960 | France | 40/158.1 |
| 80366 | 3/1963 | France | 40/124.1 |
| 1407193 | 6/1965 | France | 40/124.1 |

*Primary Examiner*—Robert Peshock
*Assistant Examiner*—J. Hakomaki
*Attorney, Agent, or Firm*—Edward M. Steutermann

[57] ABSTRACT

A message device including a planar panel, a waterproof cup defining an enclosure having an outwardly extending flange and an open end where the flange is adapted to be attached to the panel with the open end adjacent the panel and the enclosure extending through an opening where the cup is adapted to receive a water soluble capsule containing a expanable material cut in the shape of a message so that the capsule melts when it is exposed to water and allows the message piece to expand.

1 Claim, 1 Drawing Sheet

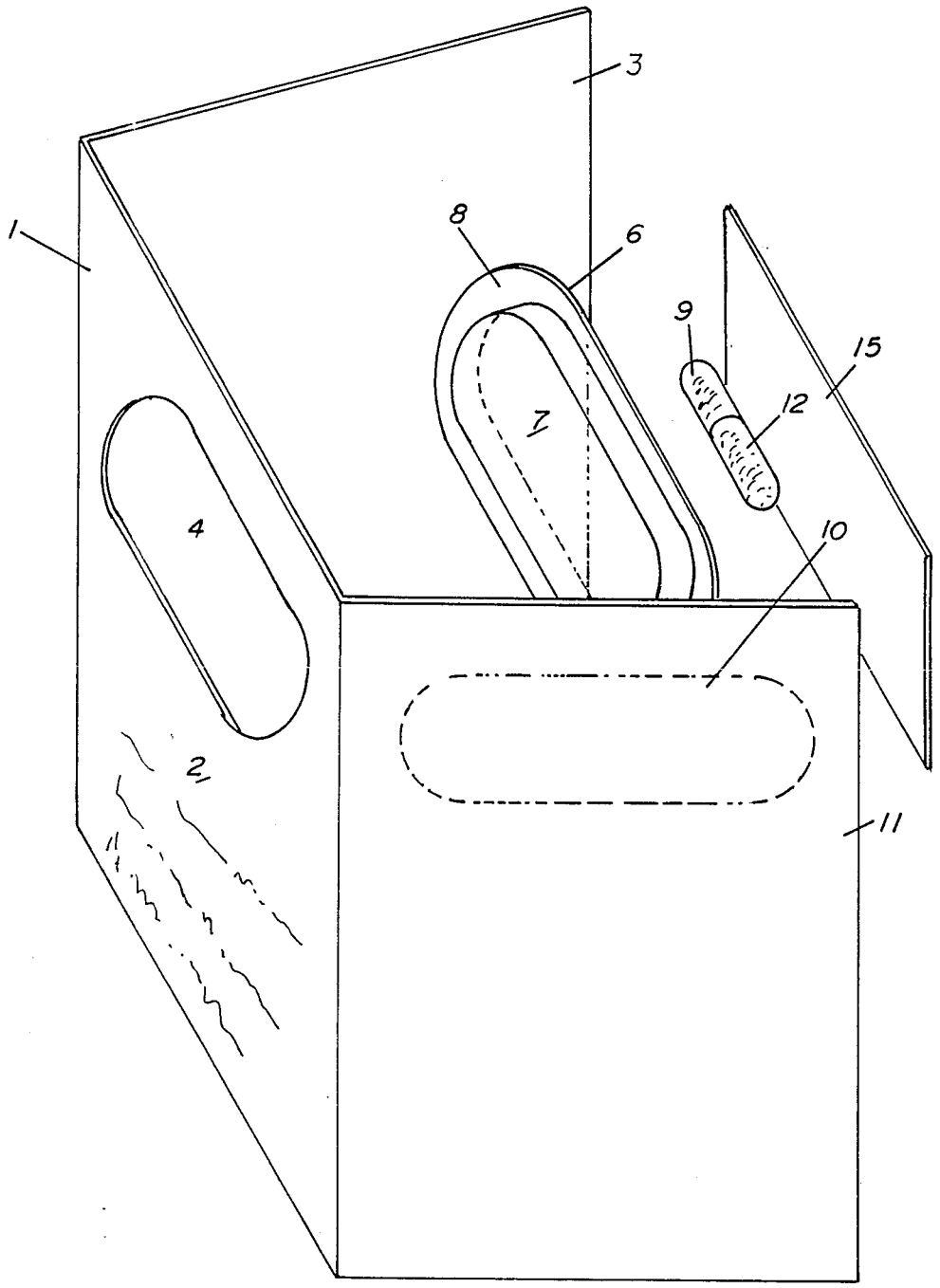
3
1
8
6
9
15
12
7
4
10
2
11

GREETING CARD ARRANGEMENT

BACKGROUND OF THE INVENTION

The present invention relates, in general, to devices that convey a message and more particularly relates to message carrying devices such as greeting cards. Various prior art greeting cards are known which include certain novel aspects.

However, no prior art greeting card is known which includes a means to retain a water soluble capsule which encloses a compressed message of and expandable material which expands upon dissolution of the capsule to allow the message to be understood.

SUMMARY OF THE INVENTION

The present invention provides a new, novel, and useful greeting card arrangement which is provided with means to carry and protect a message cut from an expandable-compressible material which is contained in a water soluble capsule carried by a water proof cup on the surface of one page of the greeting card.

Devices within the scope of the present invention can be provided with transparent cups or the cups can be translucent or opaque. In any event, devices within the scope of the present invention provide a convenient means for affixing the capsule to the cup and further provide protection for the water soluble capsule during storage. The cup can be utilized to receive the water to disolve the capsule and release the compressed message within the body of the card.

More particularly, the present invention provides a message device including a planar panel, a waterproof cup defining an enclosure having an outwardly extending flange and an open end where the flange is adapted to be attached to the panel with the open end adjacent the panel and the enclosure extending through an opening where the cup is adapted to receive a water soluble capsule containing a expanable material cut in the shape of a message so that the capsule melts when it is exposed to water and allowes the message to expand.

While various arrangements within the scope of the present invention will occur to those skilled in the art upon reading the disclosure set forth hereinafter, it will be understood that the accompanying drawings and description are by way of illustration only.

BRIEF DESCRIPTION OF THE DRAWINGS

A Drawing of one arrangement within the scope of the present invention is illustrated in the FIGURE accompanying the description and shows one example of a device within the scope of the present invention in exploded perspective.

DETAIL DESCRIPTION OF THE DRAWINGS

Referring now to the FIGURE which illustrates one arrangement within the scope of the present invention, a greeting card 1 is shown having a front message bearing panel 2 and a folded message bearing page 3 as known in the art.

In the arrangement shown panel 2 is provided with an aperture 4 adapted to receive a cup, in this case an elongate cup 6 which can be of a transparent material or a translucent or opaque material but in any event is a waterproof material.

The cup portion 7 of cup 6 is received through aperture 4 to extend outwardly from the front page 2 of the card. A capsule 9 is provided to be received within the cup 7. A flange 8 is provided to engage the inner surface of the card 2. In accordance with another feature of the present invention a second fold 11 can be provided at the edge of the page 2 to fold over the lip 8 to retain the cup within the card.

A score or perforation 10 can be provided, as shown, in page 11 to allow access box removal of the capsule 9 or to allow water to be introduced into cup 7 for dissolution of capsule 9. Alternatively, page 11 can simply be opened to the position shown in the FIGURE and the cup removed from addition of water.

Capsule 9 is received within the cup 7 and contains compressed message 12 such as the word "Happy Birthday" in an expandable elastomeric material such as urethane foam.

The capsule 9 is made of a water soluble material so that upon contact with water the capsule and releases the message 12 in the expanded, and recognizable, form. Until such time as the capsule 9 is contacted with water it is retained in the waterproof cup 7 to prevent premature release of the message.

Thus, it will be seen that the devices within the scope of the present invention provide a safe means for transporting a message and providing a new, useful, and novel greeting card arrangement.

It will be further understood that the foregoing is but one example of arrangements within the scope of the present invention that various other arrangements also within the scope of the present invention will occur to those skilled in the art upon reading the disclosure set forth hereinbefore.

The invention claimed is:

1. a message device including a planar panel having an opening, a waterproof cup having a perimetral configuration similar to said opening and an outwardly extending flange means surrounding a portion of said cup and an open end where said cup defines an enclosure and were said flange is adapted to be attached to the said planar panel with the open end adjacent said planar panel and the cup extending through said opening, a water soluble capsule containing a expanable material cut in the shape of a message so that the said water soluble capsule melts when it is exposed to water and allows the message to expand in said enclosure; and back panel means to be received over said cup opening wherein said back panel is a fold hingedly connected to said planar panel.

* * * * *